US009506184B2

(12) United States Patent
Kim et al.

(10) Patent No.: US 9,506,184 B2
(45) Date of Patent: Nov. 29, 2016

(54) DETERGENT FEEDING APPARATUS AND WASHING MACHINE HAVING THE SAME

(71) Applicant: SAMSUNG ELECTRONICS CO., LTD., Suwon-si, Gyeonggi-do (KR)

(72) Inventors: Yong Kwon Kim, Suwon-si (KR); Hong Seok Ko, Yongin-si (KR); Sang Up Lee, Yongin-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 542 days.

(21) Appl. No.: 13/734,073

(22) Filed: Jan. 4, 2013

(65) Prior Publication Data

US 2013/0174614 A1 Jul. 11, 2013

(30) Foreign Application Priority Data

Jan. 6, 2012 (KR) ..... 10-2012-0002104

(51) Int. Cl.
*D06F 39/02* (2006.01)

(52) U.S. Cl.
CPC ..... *D06F 39/028* (2013.01); *D06F 39/02* (2013.01)

(58) Field of Classification Search
None
See application file for complete search history.

(56) References Cited

U.S. PATENT DOCUMENTS 4,895,126 A * 1/1990 Nishimiya ..... F16K 1/44 123/585
5,687,590 A * 11/1997 Borroni et al. ..... 68/17 R
5,857,362 A * 1/1999 Oh ..... D06F 35/006 68/148
2007/0028653 A1* 2/2007 Thies ..... D06F 39/028 68/17 R
2010/0000586 A1* 1/2010 Hendrickson ..... 134/56 D
2012/0159999 A1* 6/2012 Hong et al. ..... 68/17 R
2012/0180533 A1* 7/2012 Song ..... D06F 39/02 68/17 R

FOREIGN PATENT DOCUMENTS

GB 2402604 A * 12/2004
KR 10-2012-0082989 7/2012

* cited by examiner

*Primary Examiner* — Michael Barr
*Assistant Examiner* — Cristi Tate-Sims
(74) *Attorney, Agent, or Firm* — Staas & Halsey LLP

(57) ABSTRACT

A detergent feeding apparatus that automatically supplies a detergent to a washing machine. The washing machine including a cabinet, a tub to accommodate water at an inside therein, and a detergent feeding apparatus to supply at least one detergent along with wash water to the tub. Wherein the detergent feeding apparatus includes a detergent container housing installed at an inside the cabinet, a detachable detergent container, and at least one valve apparatus configured in a way that the detergent accommodated at the detergent container is automatically put into the detergent container housing, wherein the at least one valve apparatus includes a detergent accommodating room to accommodate detergent at an inside therein, an inlet valve to allow the detergent in the detergent container to introduced to the detergent accommodating room, and an outlet valve to allow the detergent in the detergent accommodating room to be discharged to the detergent container housing.

26 Claims, 14 Drawing Sheets

DETERGENT FEEDING APPARATUS AND WASHING MACHINE HAVING THE SAME

CROSS-REFERENCE TO RELATED APPLICATIONS

This application claims the benefit of Korean Patent Application No. 10-2012-0002104, filed on Jan. 6, 2012 in the Korean Intellectual Property Office, the disclosure of which is incorporated herein by reference.

BACKGROUND

1. Field

Embodiments of the present disclosure relate to a washing machine, and more particularly, to a detergent feeding apparatus configured to supply suggested amount of detergent 2. Description of the Related Art A washing machine is an apparatus configured to wash clothes comprising a tub to store wash water, a drum rotatively installed at an inside the tub, and a motor to drive the drum.

In a state when a laundry and detergent water are put unto an inside the drum, as the drum is rotated by the motor, the laundry is cleaned.

As the type of the detergent used to remove stain on a laundry, a powder detergent and a liquid detergent are present, and recently, compared with the power detergent, the liquid detergent that dissolves well in water and is not scattered by a wind is widely being used.

A detergent is automatically introduced to the drum, but prior to being introduced to the drum, a user is needed to put a certain amount of detergent into a detergent container before performing a wash operation.

As a user puts detergent into the detergent container, a designated amount of the detergent may not be supplied, and as the detergent is needed to be put into every time when a wash is needed, the detergent is needed to be automatically supplied.

SUMMARY

Therefore, it is an aspect to provide a detergent feeding apparatus capable of automatically supply a detergent, and a washing machine having the same.

It is another aspect to provide a detergent feeding apparatus capable of supplying suggested amount of detergent, and a washing machine having the same.

Additional aspects will be set forth in part in the description which follows and, in part, will be obvious from the description, or may be learned by practice of the disclosure.

In accordance with one aspect, a washing machine includes a cabinet, a tub, and a detergent feeding apparatus. The tub may be disposed at an inside the cabinet to accommodate water at an inside therein. The detergent feeding apparatus may be configured to supply at least one detergent along with wash water to the tub. The detergent feeding apparatus may include a detergent container housing, a detergent container, and at least one valve apparatus. The detergent container housing may be installed at an inside the cabinet. The detergent container may be detachably mounted at the detergent container housing while accommodating detergent. The at least one valve apparatus may be configured in a way that the detergent accommodated at the detergent container is automatically put into the detergent container housing. The at least one valve apparatus includes a detergent accommodating room, an inlet valve and an outlet valve. The detergent accommodating room may be configured to accommodate detergent at an inside therein. The inlet valve may be configured in a way that the detergent at the detergent container is introduced to the detergent accommodating room. The outlet valve may be configured in a way that the detergent at the detergent accommodating room is discharged to the detergent container housing.

The inlet valve and the outlet valve may alternatively operate, and an introduction of the detergent into the detergent accommodating room and a discharge of the detergent from the detergent accommodating room are alternatively occurred.

The detergent feeding apparatus may further include a valve driving unit disposed at a lower portion of the valve apparatus, and may be configured in a way that the inlet valve and the outlet valve are alternatively operated.

The valve apparatus my further include an inlet shaft configured to allow the inlet valve to operate in a way to move vertically, and an outlet shaft configured to allow the outlet valve to operate in a way to move vertically.

The valve driving unit may include a cam rotatively disposed at a lower portion of the valve apparatus. As the cam is rotated, the outlet shaft and the inlet shaft are alternatively ascended or descended.

The cam may include an inlet protrusion to move the inlet shaft vertically, and an outlet protrusion to move the outlet shaft vertically.

The inlet protrusion and the outlet protrusion may be formed while facing opposite direction to each other.

The detergent feeding apparatus may further include an outlet hole to discharge wash water to the outlet valve.

The detergent container may include an automatic detergent accommodating unit at which detergent automatically supplied by the valve apparatus is accommodated, and a manual detergent accommodating unit at which detergent manually supplied is accommodated.

The automatic detergent accommodating unit may be connected to the at least one valve apparatus.

The detergent feeding apparatus, in order to supply wash water to the manual detergent accommodating unit, may further include a dispenser mounted at an inside the detergent container housing while being disposed at an upper portion of the manual detergent accommodating unit.

The dispenser may include at least one flow path configured to supply wash water to the manual detergent accommodating unit.

The detergent feeding apparatus may further include a distribution flow path that is configured to supply wash water to the valve apparatus and connected to the dispenser.

The at least one flow path may include a distribution hole formed in a way that wash water is distributed to the distribution flow path.

The distribution flow path may include an outlet hole formed at one end portion of the distribution flow path to discharge wash water toward the valve apparatus.

The dispenser may include at least one partition to divide the at least one flow path, and a distribution protrusion protrudedly formed from the partition to surround a portion of the distribution hole.

By controlling a size of the distribution protrusion, the amount of wash water introduced to the distribution hole may be controlled.

In accordance with one aspect, a detergent feeding apparatus includes a detergent container, a detergent container housing and a valve apparatus. The detergent container may be configured to accommodate detergent. The detergent container housing may be configured to accommodate the detergent container. The valve apparatus may be configured in a way that the detergent accommodated at the detergent container may be automatically input to the detergent container housing. The valve apparatus may include a detergent inlet hole and a detergent outlet hole. The detergent inlet hole may be configured in a way that detergent is introduced to an inside the valve apparatus, and the detergent outlet hole may be configured in a way that detergent is discharged to the detergent container housing from the inside the valve apparatus. The detergent inlet hole and the detergent outlet hole may be alternatively open/closed.

The valve apparatus may further include an inlet valve to open/close the detergent inlet hole, and an outlet valve to open/close the detergent outlet hole.

Wash water may be supplied toward the detergent outlet hole.

In accordance with one aspect, a detergent feeding apparatus includes a detergent container housing, a detergent container, a dispenser, and a valve apparatus. The detergent container may include a manual detergent accommodating unit and an automatic detergent accommodating unit. The manual detergent accommodating unit may be configured to entirely input detergent, which is input thereinto, to the detergent container housing. The automatic detergent accommodating unit may be configured to input some of detergent being accommodated therein to the detergent container housing. The dispenser may be configured to supply wash water to the manual detergent accommodating unit. The valve apparatus may be configured in a way that the detergent being accommodated at the automatic detergent accommodating unit is automatically input to the detergent container housing. The valve apparatus may include an inlet valve and an outlet valve. The inlet valve may be configured in a way that detergent is selectively introduced to an inside the valve apparatus. The outlet valve may be configured in a way that the detergent at the inside the valve apparatus is selectively discharged to the detergent container housing.

The detergent feeding apparatus may further include a distribution flow path configured in a way that wash water at the dispenser is distributed to the valve apparatus.

The distribution flow path may be configured to discharge wash water to the outlet valve of the valve apparatus.

The dispenser may include a distribution hole configured in a way that wash water is introduced to the distribution flow path.

The dispenser may include a distribution protrusion formed around the distribution hole to introduce wash water to the distribution hole.

As a user inputs detergent at one time, a certain amount of detergent is automatically input to an inside a tub.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
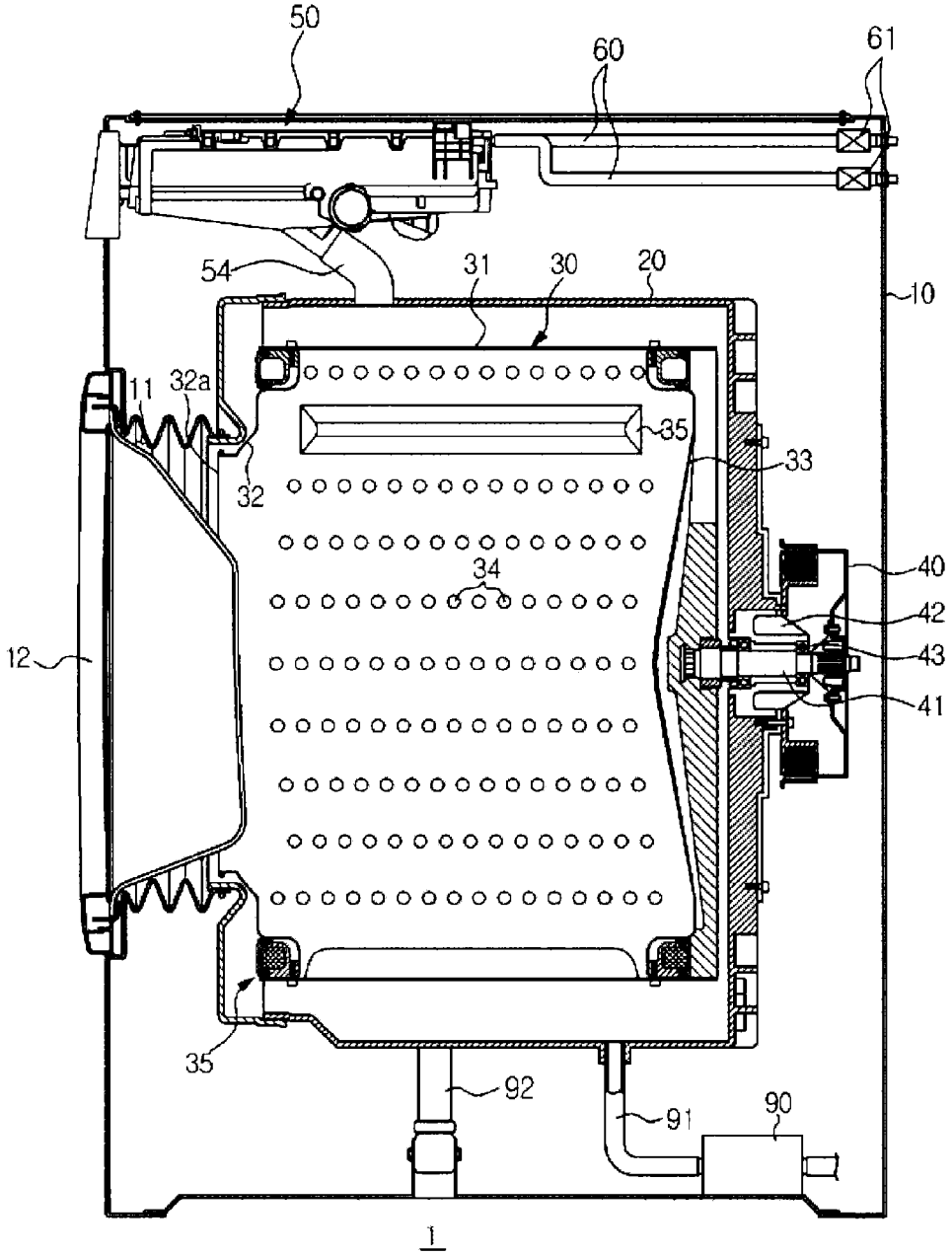
FIG. 1 is a drawing illustrating a structure of a washing machine in accordance with one embodiment.

Reference will now be made in detail to the embodiments, examples of which are illustrated in the accompanying drawings, wherein like reference numerals refer to like elements throughout.

FIG. 1 is a drawing illustrating a structure of a washing machine in accordance with one embodiment.

As illustrated on FIG. 1, a washing machine 1 includes a cabinet 10 forming an exterior, a tub 20 disposed at an inside the cabinet 10, a drum 30 rotatively disposed at an inside the tub 20, and a motor 40 to drive the drum 30.

An input hole 11 is formed at a front surface unit of the cabinet 10 to input a laundry to an inside the drum 30. The input hole 11 is open/closed by a door 12 installed at a front surface of the cabinet 10.

The tub 20 is supported by a damper 92. The damper 92 connects a bottom surface of an inner side of the cabinet 10 to an outer surface of the tub 20.

A drain pump 90 and a drain pipe 91 are installed at a lower portion of the tub 20 to discharge the water at an inside the tub 20 to an outside the cabinet 10.

The drum 30 includes a cylindrical unit 31, a front surface panel 32 disposed at a front of the cylindrical unit 31, and a rear surface panel 33 disposed at a rear of the cylindrical unit 31. An opening hole 32*a* is formed at the front surface panel 32 for an entry/exit of a laundry, and a driving shaft 41 is connected to the rear panel 33 to deliver a driving force of the motor 40.

A plurality of through-holes 34, are provided at a circumference of the drum 30, such that an inside space of the drum 30 and an inside space of the tub 20 are communicated with one another, allowing wash water to pass through.

A plurality of lifters 35 are installed at an inner circumferential surface of the drum 30, such that a laundry may ascend and descend when the drum 30 is rotated.

A driving shaft 41 is disposed in between the drum 30 and the motor 40. One end of the driving shaft 41 is connected to the rear surface panel 33 of the drum 30, and the other end of the driving shaft 41 is extended to the outside of the rear wall of the tub 20. As the motor 40 drives the driving shaft 41, the drum 30 connected to the driving shaft 41 is rotated while having the driving shaft 41 as a center of rotation.

A bearing housing 42 is installed at a rear wall of the tub 20, such that the driving shaft 41 is rotatively supported. The bearing housing 42 may be provided in aluminum alloy, and may be inserted into a rear wall of the tub 20 when forming the tub 20 through an injection molding. Bearings 43 are installed in between the bearing housing 42 and the driving shaft 41, such that the driving shaft 41 may be smoothly rotated.

In a wash cycle, the motor 40 rotates the drum 30 at low speed in a reverse direction as well as in a normal direction, and accordingly, the laundry at an inside the drum 30 repeats the ascending and descending motions, and thus, stain is removed from the laundry.

In a spin-dry cycle, as the motor 40 rotates the drum 30 in a single direction at high speed, by the centrifugal force applied to the laundry, water is separated from the laundry.

In a spin-dry process, as the drum 30 is rotated, if the laundry is eccentrically placed at a particular portion at an inside the drum 30 without being evenly distributed, unbalanced load is generated in the drum 30, and the rotational motion of the drum 30 becomes less stable, and thus vibration and noise are generated.

Thus, the washing machine 1 may include a balancer 35 to stabilize the rotation motion of the drum 30. The balancer 35 may be formed in pairs, as one of the pair of balancers 35 is formed at the front surface panel 32 of the drum 30, while the other one of the pair of balancers 35 is formed at the rear surface panel of the drum 30.

A water supply pipe 60 is installed at an upper side of the tub 20 to supply wash water to the tub 20. One end portion of the water supply pipe 60 is connected to an outside water supply source (now shown), while the other end portion of the water supply pipe 60 is connected to a detergent feeding apparatus 50.

The detergent feeding apparatus 50 is connected to the tub 20 through a connecting hose 54. The water supplied through the water supply pipe 60 passes through the detergent feeding apparatus 50, and, along with the detergent, is supplied to an inside the tub 20.

Figure 2:
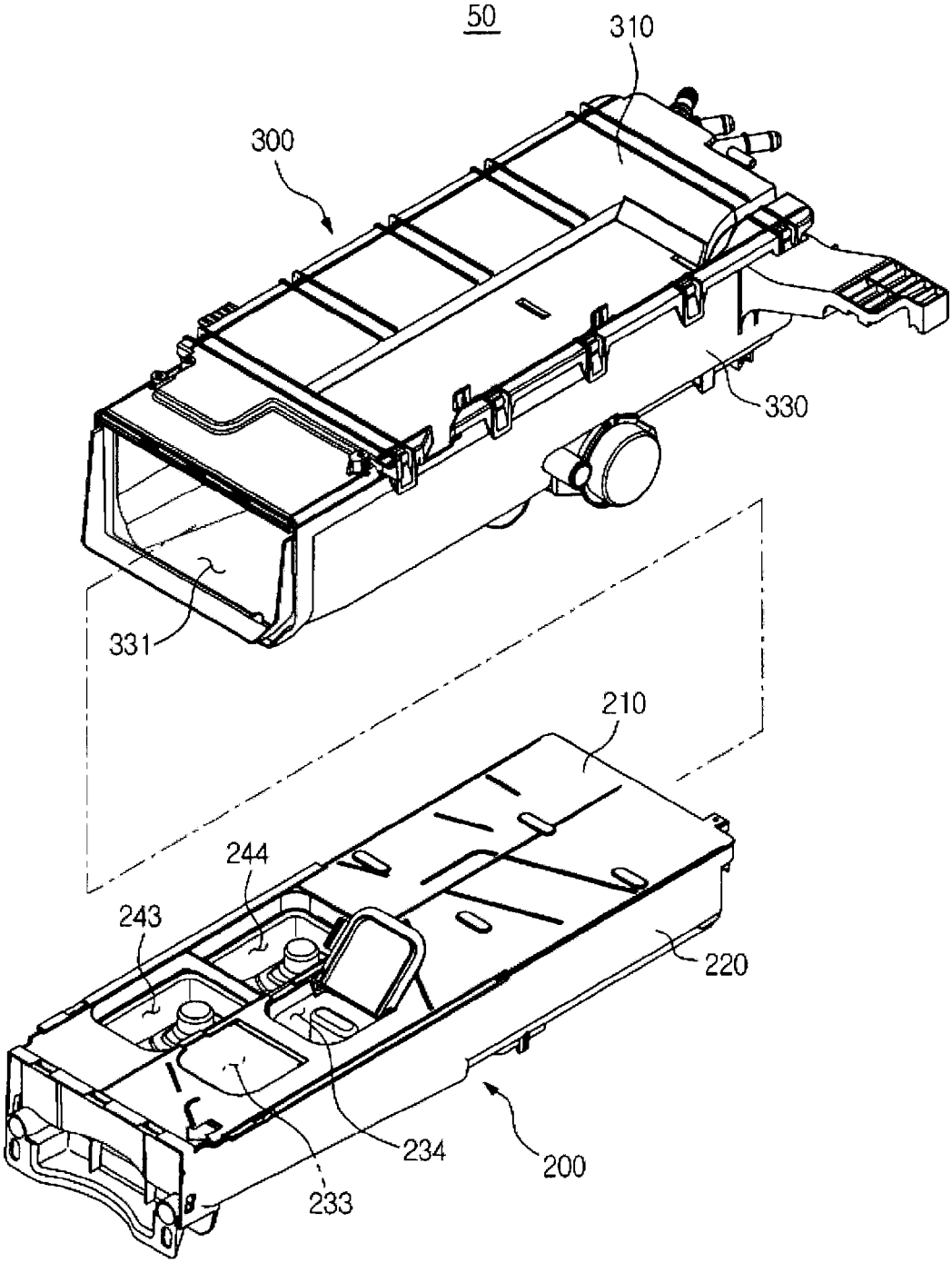
FIG. 2 is a perspective view illustrating a detergent feeding apparatus of a washing machine in accordance with one embodiment.

FIG. 2 is a perspective view illustrating a detergent feeding apparatus of a washing machine in accordance with one embodiment.

As illustrated on FIG. 2, the detergent feeding apparatus 50 includes a detergent container 200, and a detergent container housing 300 to accommodate the detergent container 200.

The detergent container 200, is inserted in a detergent container inserting hole 331 formed at a front of the detergent container housing 300. The detergent container 200 may be mounted to an inside the detergent container housing 300 in a sliding manner.

The detergent container housing 300 is fixedly mounted at the washing machine 1 (see, for example, FIG. 1), and a user inputs a detergent into the detergent container 200 after separating only the detergent container 200 from the detergent container housing 200, and then the user mounts the detergent container 200 again to the detergent container housing 300.

Figure 3:
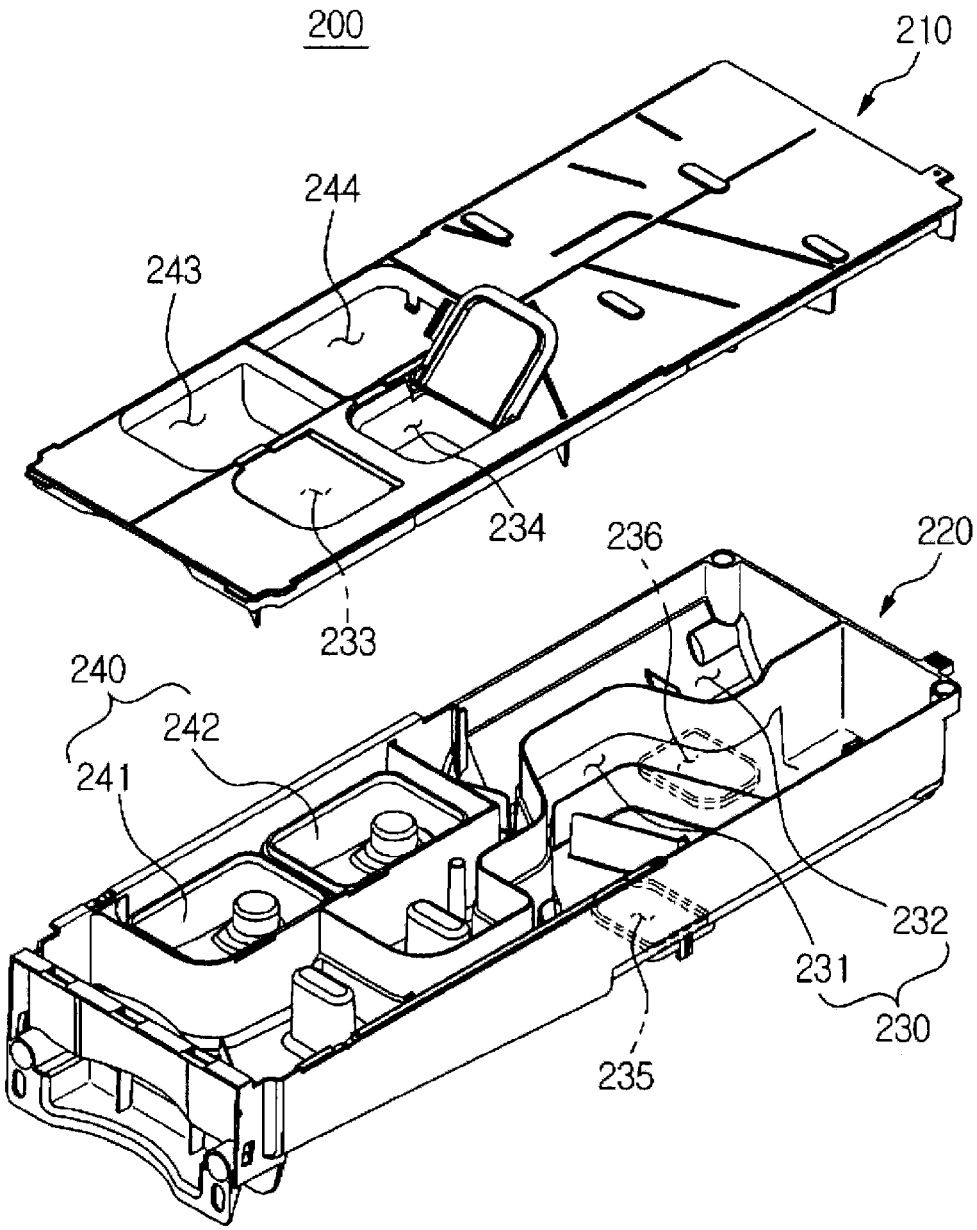
FIG. 3 is a perspective view illustrating a detergent container of the detergent feeding apparatus on FIG. 2.

FIG. 3 is a perspective view illustrating a detergent container of the detergent feeding apparatus on FIG. 2.

As illustrated on FIG. 3, a detergent container body 220 forms the exterior of the detergent container 200. A detergent container cover 210 may be mounted at an upper portion of the detergent container body 220, such that the detergent contained at the detergent container body 220 is prevented from overflowing.

An automatic detergent accommodating unit 230 is formed at an inside the detergent container body 220, such that, in a case when a user inputs excessive amount of the detergent at one time, suggested amount of detergent among the detergent input by the user is automatically input to an inside the drum 30 (see FIG. 1). A manual detergent accommodating unit 240 may be formed at an inside the detergent container body 220 while being separately divided from the automatic detergent accommodating unit 230. The manual detergent accommodating unit 240 may be provided in a way that a user can manually input a detergent at the time when a wash is needed to be performed.

The automatic detergent accommodating unit 230, is needed to accommodate a large amount of detergent at one time, and thus, the automatic detergent accommodating unit 230 is formed to have a width wider than the manual detergent accommodating unit 240.

In the embodiment, it is illustrated that the automatic detergent accommodating unit 230 and the manual detergent accommodating unit 240 are formed in the detergent container body 220, but an embodiment having only the automatic detergent accommodating unit 240 formed may be included in the present disclosure.

The automatic detergent accommodating unit 230 may include a first accommodating unit 231 and a second accommodating unit 232. A liquid detergent is input into either the first accommodating unit 231 or the second accommodating unit 232, and a fabric softener or a bleach agent may be input into the other one of the first accommodating unit 231 and the second accommodating unit 232. In the embodiment, only the first accommodating unit 231 and the second accommodating unit 232 are illustrated, but having three or more than three accommodating units formed may be included in the embodiment of the present disclosure.

The manual detergent accommodating unit 240 includes a third accommodating unit 241 and a fourth detergent accommodating unit 242, and a liquid detergent is input into either the third accommodating unit 241 or the fourth accommodating unit 242, and a fabric softener or a bleach agent may be input into the other one of the third accommodating unit 241 and the fourth accommodating unit 242.

A valve mounting hole 235 and a valve mounting hole 236 are formed at a bottom of the first accommodating unit 231 and a bottom of the second accommodating unit 232 of the automatic detergent accommodating unit 230, respectively, and a valve apparatus 100 may be mounted to each of the valve mounting hole 235 and the valve mounting hole 236.

The detergent container cover 210 is mounted at an upper portion of the detergent container body 220. At the detergent container cover 210, detergent input holes 233, 234, 243, and 244 are formed at the positions to which the first accommodating unit 231, the second accommodating unit 232, the third accommodating unit 241, and the fourth accommodating units 242 correspond. Through the detergent input holes 233, 234, 243, and 244, a user inputs a detergent to the accommodating units 230 and 240.

Figure 4:
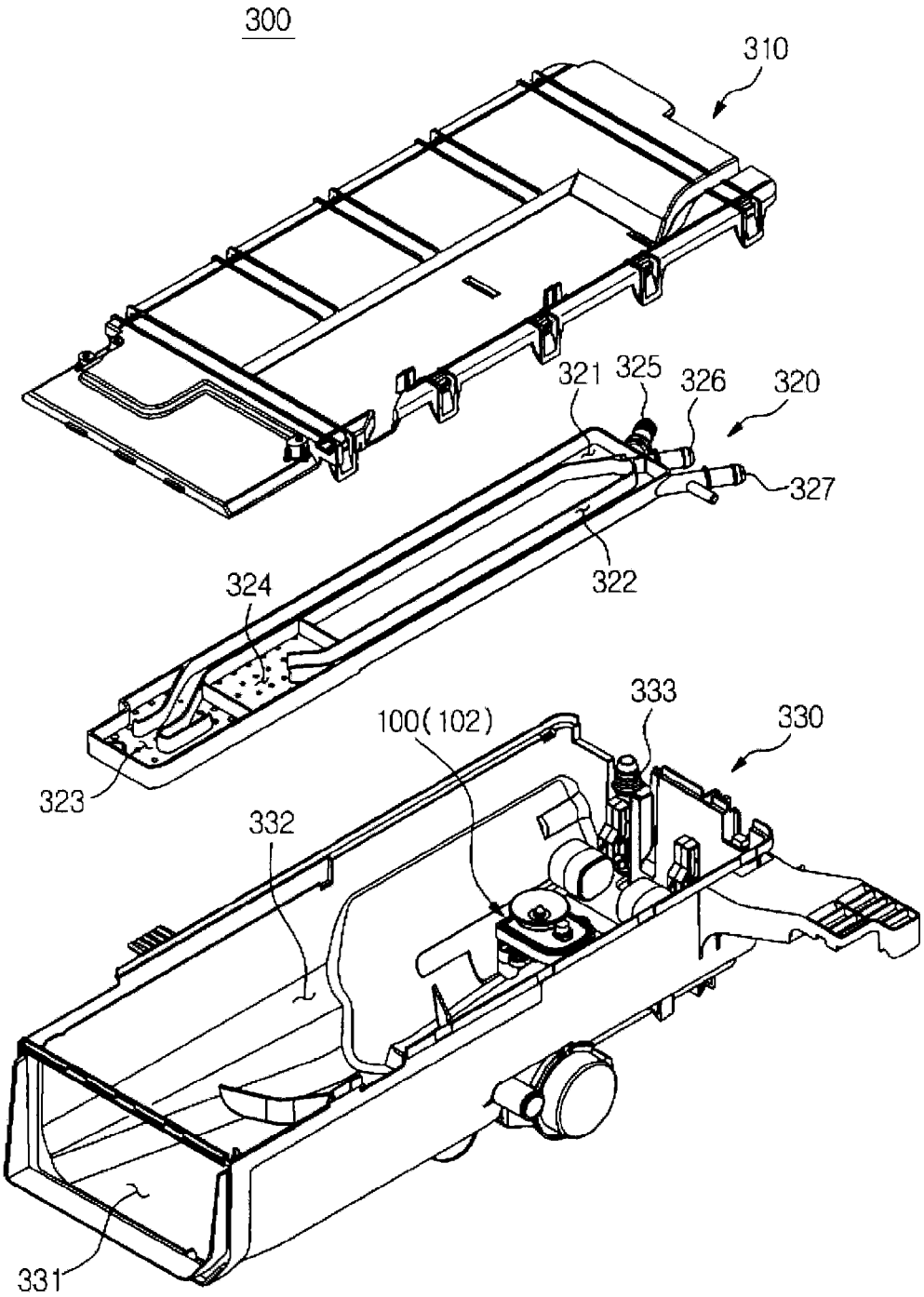
FIG. 4 is a perspective view illustrating a detergent container housing of the detergent feeding apparatus on FIG. 2.

FIG. 4 is a perspective view illustrating a detergent container housing of the detergent feeding apparatus on FIG. 2.

As illustrated on FIG. 4, a housing body 330 having an open front portion and an upper portion thereof forms an overall exterior of the detergent container housing 300. The detergent container inserting hole 331 is formed at the open front portion of the housing body 330, such that the detergent container 200 (FIG. 2) may be inserted into in a sliding manner. A dispenser 320 having at least one flow path may be mounted at the open upper portion of the housing body 330. A housing cover 310 may be mounted at an upper portion of the dispenser 320 to cover the dispenser 320 and the housing body 330.

The dispenser 320 includes a first flow path 321 and a second flow path 322. Two units of water supply pipe 60 may be connected to the first flow path 321 to supply cold water and hot water, and for such, a first connecting pipe 325 and a second connecting pipe 326 may be formed. A third connecting pipe 327 may be formed at the second flow path 322, such that the second flow path 322 may be connected to the one water supply pipe 60.

The first flow path 321 is connected to a first wash water outlet unit 323. The first wash water outlet unit 323 is formed at a position allowing the third accommodating unit 241 is disposed at a lower portion of the first wash water outlet unit 323 in a state that the detergent container 200 (FIG. 3) is insertedly mounted into the housing body 330. The second flow path 322 is connected to a second wash water outlet unit 324. The second wash water outlet unit 324 is formed at a position allowing the fourth accommodating unit 242 to be disposed at a lower position of the second wash water outlet unit 324 in a state the detergent container 200 (FIG. 3) is insertedly mounted into the housing body 330.

That is, the dispenser 320 exists to supply wash water to the manual detergent accommodating unit 240. In order to supply suggested amount of detergent, wash water is not directly supplied to the automatic detergent accommodating unit 230, but supplied through another path. The description for such will be provided on FIG. 13.

Figure 5:
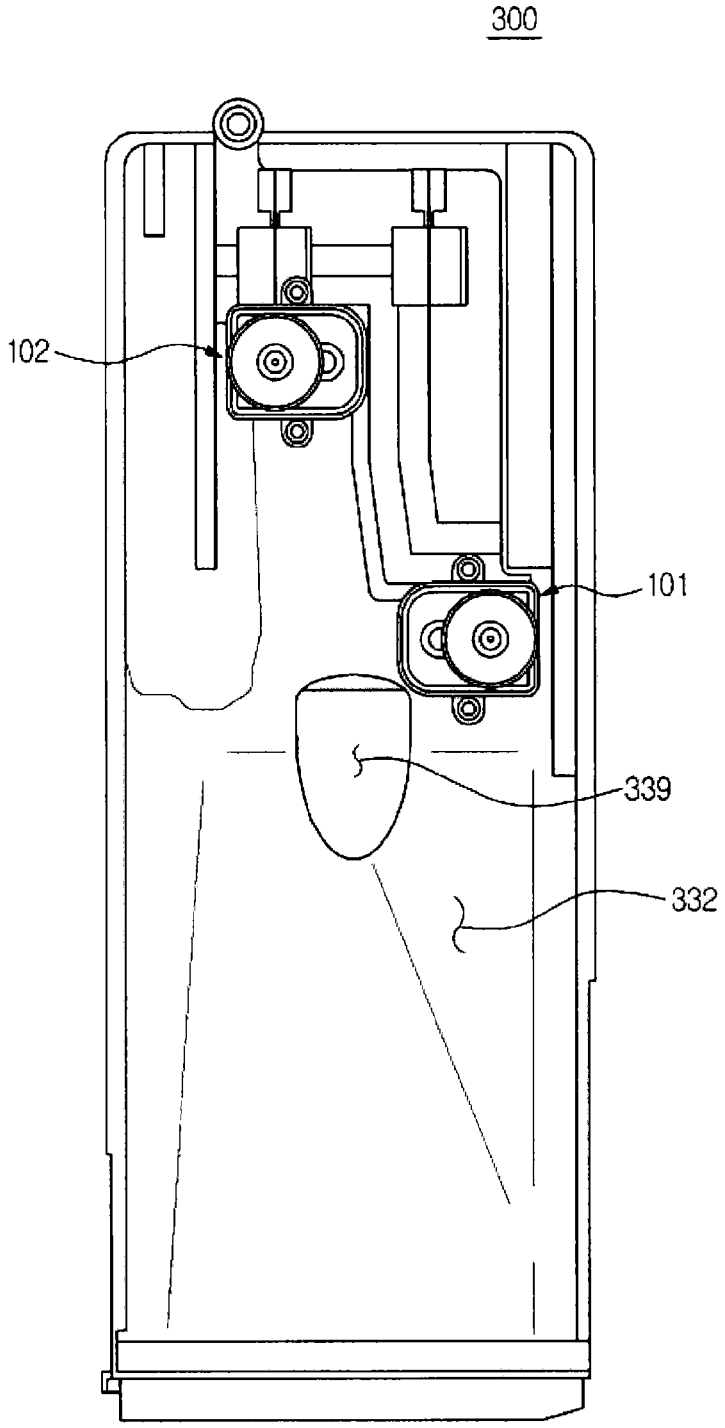
FIG. 5 is a top view a housing body of the detergent container housing on FIG. 4.

FIG. 5 is a top view a housing body of the detergent container housing on FIG. 4.

As illustrated on FIGS. 4 and 5, a housing room 332 is formed at an inside the detergent container housing 300. The detergent container 200 is accommodated at an inside the housing room 332. A wash water outflow hole 339 may be formed at a lower portion of the housing room 332, such that the wash water mixed with the detergent may outflow toward the tub 20 (FIG. 1).

An opening hole (not shown) is formed at a lower portion of each of the third accommodating unit 241 (FIG. 3) and the fourth accommodating unit 242 (FIG. 3) of the detergent container 200 (FIG. 3), such that the wash water mixed with the detergent flows into the housing room 332 through the opening holes.

A first valve mounting hole 235 (FIG. 3) and a second valve mounting hole 236 (FIG. 3) are respectively formed at a lower portion of the first accommodating unit 231 (FIG. 3) and at a lower portion of the second accommodating unit 232 (FIG. 3) that are formed at an inside the automatic detergent accommodating unit 230 (FIG. 3) at an inside the detergent container 200 (FIG. 3). With respect to the housing body 330, a first valve apparatus 101 and a second valve apparatus 102 are mounted at positions corresponding to the first valve mounting hole 235 and the second valve mounting hole 236, respectively.

Each of the first valve apparatus 101 and the second valve apparatus 102 is connected to the first accommodating unit 231 and the second accommodating unit 232, respectively, through the first valve mounting hole 235 and the second valve mounting hole 236.

Figure 6:
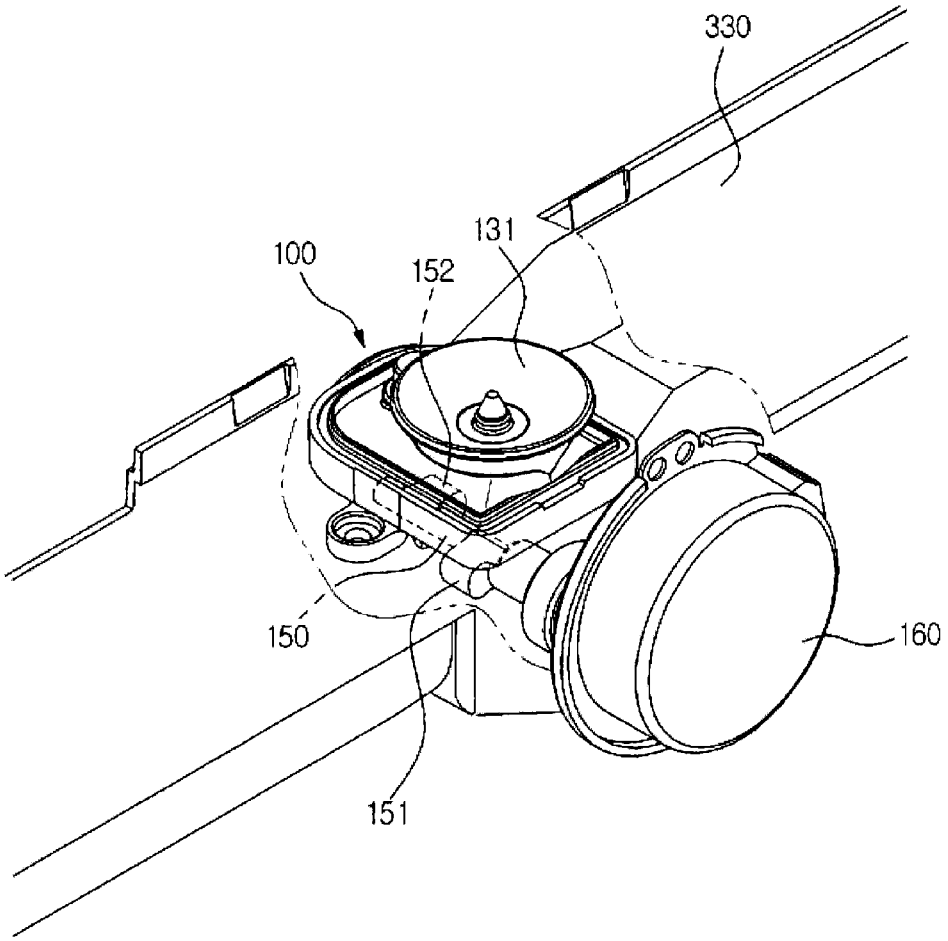
FIG. 6 is a drawing illustrating a valve apparatus of the detergent feeding apparatus on FIG. 2.

FIG. 6 is a drawing illustrating a valve apparatus and a valve driving unit of the detergent feeding apparatus on FIG. 2.

As illustrated on FIG. 6, a valve driving unit is disposed at a lower portion of the valve apparatus 100. The valve driving unit may include a cam 150 and a motor 160.

The valve apparatus 100, as previously described, is disposed at the housing room 332 at an inside the detergent container housing 300. The housing room 332 is the portion through which wash water passes, and thus, the housing room 332 is not suitable for the motor 160 to be disposed. Thus, the motor 160 is disposed at an outside the detergent container housing 300. For such, the cam 150 is disposed in a way to penetrate the sidewall of the detergent container housing 300, such that the cam 150 may be connected to the valve apparatus 100 disposed at an inside the housing room 332 and to the motor 160 disposed at an outside the detergent container housing 300.

Figure 7:
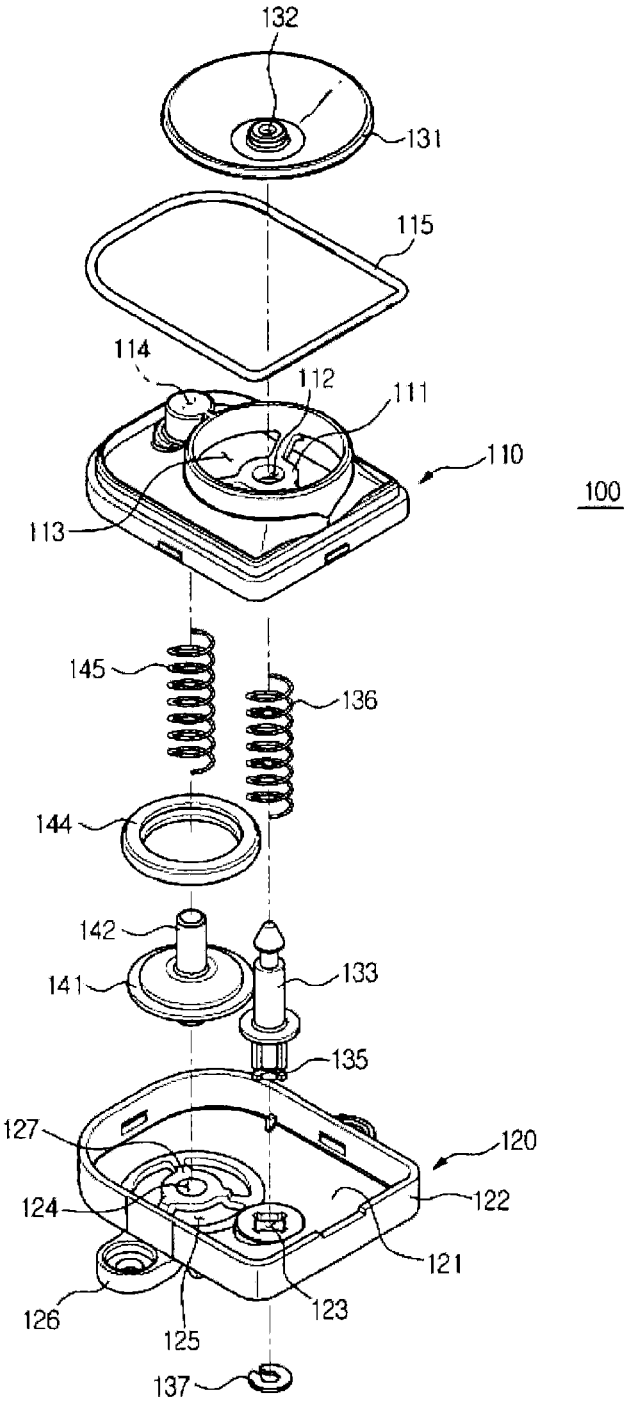
FIG. 7 is a drawing illustrating a structure of the valve apparatus of FIG. 6.
Figure 9:
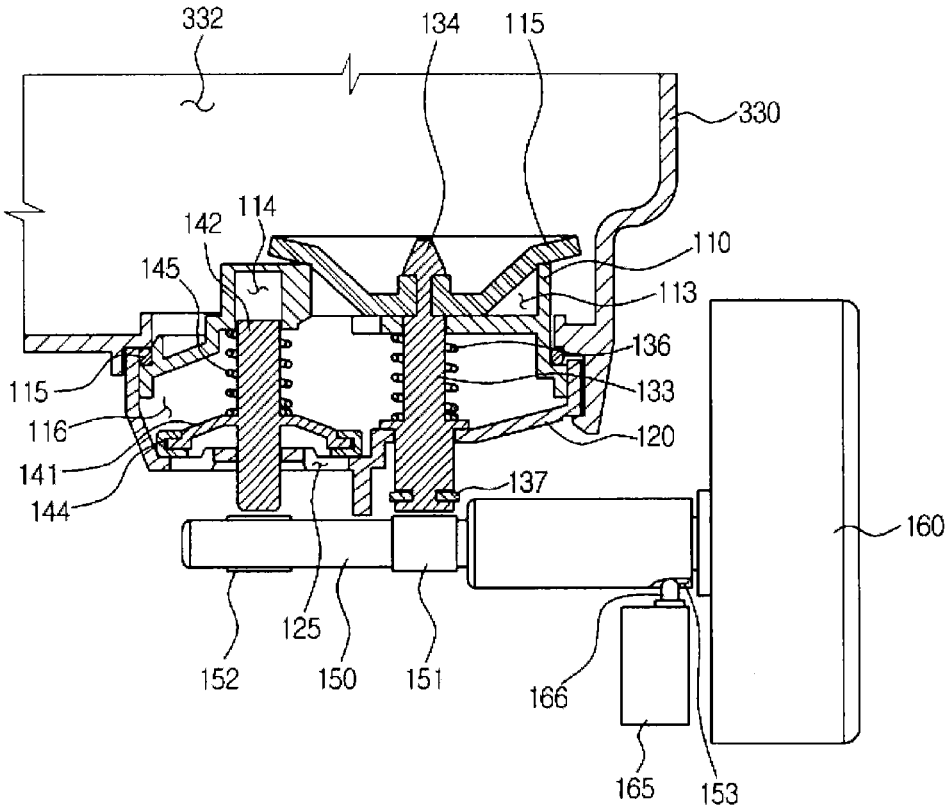
FIG. 9 is a cross-sectional view of the valve apparatus on FIG. 6.

FIG. 7 is a drawing illustrating a structure of the valve apparatus on FIG. 6. FIG. 9 is a cross sectional view illustrating the valve apparatus on FIG. 6.

As illustrated on FIGS. 7 and 9, the valve apparatus 100 forms an exterior as an upper portion cap 110 and a lower portion cap 120 are coupled to each other. The lower portion cap 120 includes a cap bottom 121, and a cap side surface 122 protrudedly formed from the cap bottom 121 toward an upper side. The upper portion cap 110 is inserted into an inner side of the cap side surface 122, and is coupled to the lower portion cap 120. After the upper portion cap 111 is insertedly mounted into the lower portion cap 120, a cap sealing member 115 is inserted into a coupling portion of the upper portion cap 110 and the lower portion cap 120, and wash water is prevented from being introduced to an inside the valve apparatus 100. The lower portion cap 120 and the upper portion cap 110 are coupled to each other to form a detergent accommodating room 116 at an inside therein.

The size of the detergent accommodating room 116 may be formed differently according to embodiments. By controlling the size of the detergent accommodating room 116, the amount of the detergent introduced from the detergent container 200 to the housing room 332 may be controlled.

As a portion of an upper portion of the upper portion cap 110 is open, a detergent inlet hole 113 is formed. A first supporting leg 111 is provided at an inside the detergent inlet hole 113, and as a central portion of the first supporting leg 111 is open, an upper portion mounting hole 112, at which an inflow shaft 133 may be mounted, may be formed.

The inflow shaft 133 is provided at an inside the detergent accommodating room 116, and is configured to move vertically. An upper end of the inflow shaft 133 may be formed in a pointed manner, so that the upper end of the inflow shaft 133 may be fixedly inserted into a shaft mounting hole 132, which is formed at a central portion of an inlet valve 131.

The inflow shaft 133 penetrates the upper portion mounting hole 112, and is coupled to the inlet valve 131 at an upper portion of the detergent inlet hole 113. As the inflow shaft 133 and the inlet valve 131 are coupled to each other, and thus, if the inflow shaft 133 moves vertically, the inlet valve 131 also is moved vertically.

The inlet valve 131 is provided with a shape having a width gradually increasing from a lower portion thereof to a upper portion thereof, and may be formed in a shape of a cone as a whole. The upper portion of the inlet valve 131 has a width equal to or wider the detergent inlet hole 113, so that, when the inlet valve 131 makes contact with the detergent inlet hole 113, the detergent inlet hole 113 is closed, and when the inlet valve 131 is moved to an upper portion by the inflow shaft 133, the detergent inlet hole 113 is open.

The inflow shaft 133 is inserted into a lower portion settling unit 123 formed at the cap bottom 121. The lower portion settling unit 123 may be formed as the cap bottom 121 of the lower portion cap 120 is open. A groove 135 may be formed at a lower end of the inflow shaft 133, so that an inflow shaft sealing member 137 may be mounted to the lower end of the inflow shaft 133. The inflow shaft 133 penetrates the lower portion settling unit 123, and is protruded in a lower direction of the lower portion cap 120. The portion protruded in a lower direction of the lower portion cap 120 makes contact with the cam 150, which will be described later, and performs a role in moving the inflow shaft 133 entirely in a vertical direction.

A first spring 136 is disposed in between the inflow shaft 133 and the upper portion cap 110. The inflow shaft 133 penetrates the first spring 136, and is coupled to the inlet valve 131. The first spring 136, by the elasticity thereof, performs a role in applying a pressure on the inflow shaft 133 toward a lower side. Since the inlet valve 131 normally closes the detergent inlet hole 113 and temporarily opens the detergent inlet hole 113 for the detergent to be introduced to the detergent accommodating room 116, the inflow shaft 133 is needed to be pressed toward a lower side.

As a portion of the cap bottom 121 of the lower portion cap 120 is open, a detergent outlet hole 125 is formed. A second supporting leg 127 is provided at an inside the detergent outlet hole 125, and as a central portion of the second supporting leg 127 is open, a lower portion mounting hole 124 may be formed.

A outlet shaft 142 penetrates the lower portion mounting hole 124, and is protruded toward a lower side of the lower portion cap 120. An outlet valve 141 is formed by protruded in a radius direction toward an outer side from the central portion of the outlet shaft 142. The outlet valve 141 may be integrally formed with the outlet shaft 142, or may be separately manufactured and coupled. At the outlet valve 141, an outlet valve sealing member 144 in a shape of a ring is coupled to the outlet valve 141 while being inserted around the outlet valve 141.

The outlet shaft 142 is provided so as to enable a vertical movement at an inside the detergent accommodating room 116. Thus, the outlet valve 141 coupled to the outlet shaft 142 is configured to move vertically at an inside the detergent accommodating room 116.

An upper end of the outlet shaft 142 is accommodated at an upper portion settling unit 114 provided at the upper portion cap 110. The upper portion settling unit 114, by considering the outlet shaft 142 that moves vertically, may be protrudedly formed from the upper portion cap 110 toward an upper side.

The outlet valve 141 is formed larger than the detergent outlet hole 125, so that, when the outlet valve 141 makes contact with the detergent outlet hole 125, the outlet valve 141 closes the detergent outlet hole 125, and when the outlet valve 141 moves toward an upper side and is spaced apart from the detergent outlet hole 125, the outlet valve 141 opens the detergent outlet hole 125.

A second spring 145 is disposed in between the outlet valve 141 and the upper portion settling hole 114 to press the outlet valve 141 to a lower side. As same as the inlet valve 131, the outlet valve 141 as well is normally needed to close the detergent outlet hole 125.

A coupling unit 126 is formed at a side surface of the lower portion cap 120 to mount the valve apparatus 100 to the detergent container housing 300.

Figure 8:
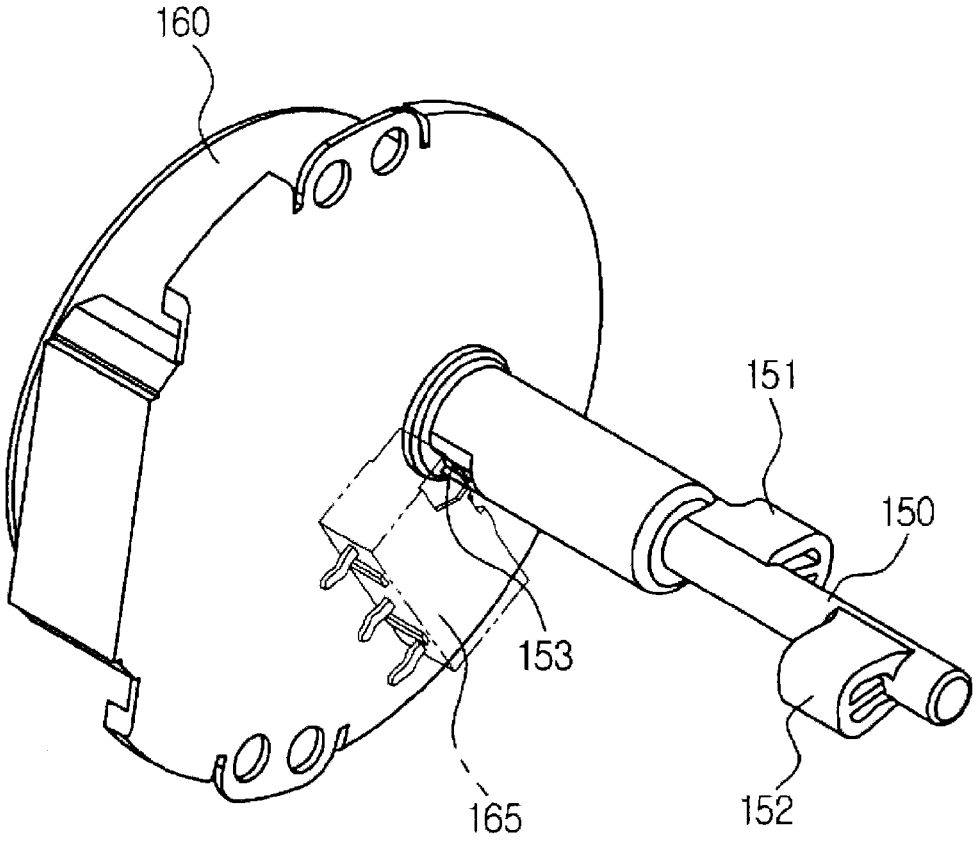
FIG. 8 is a drawing illustrating a valve driving unit of the valve apparatus of FIG. 6.

FIG. 8 is a drawing illustrating a valve driving unit of the valve apparatus of FIG. 6.

As illustrated on FIGS. 8 and 9, a driving unit is disposed at a lower side of the valve apparatus 100. The driving unit may include the cam 150, and the motor 160 coupled to one end portion of the cam 150. The cam 150 may include an outlet protrusion 152 and an inlet protrusion 151.

The outlet protrusion 152 is disposed at a lower side of the outlet shaft 142, and performs a role in moving the outlet shaft 142 vertically. The inlet shaft 151 is disposed at a lower side of the inlet shaft 133, and performs a role in moving the inlet shaft 133 vertically.

As the outlet shaft 142 and the inlet shaft 133 are needed to alternatively ascend or descend, the outlet protrusion 152 and the inlet protrusion 151 are protruded while facing opposite direction to each other.

The motor 160 is configured to rotate the cam 150. A position determining groove may be formed at an end portion of the cam 150. As a switch protrusion 166 of a switch 165 electrically connected to the motor 160 is disposed to make contact with the position determining groove 153, the position at which the cam 150 is rotated may be determined.

Figure 10:
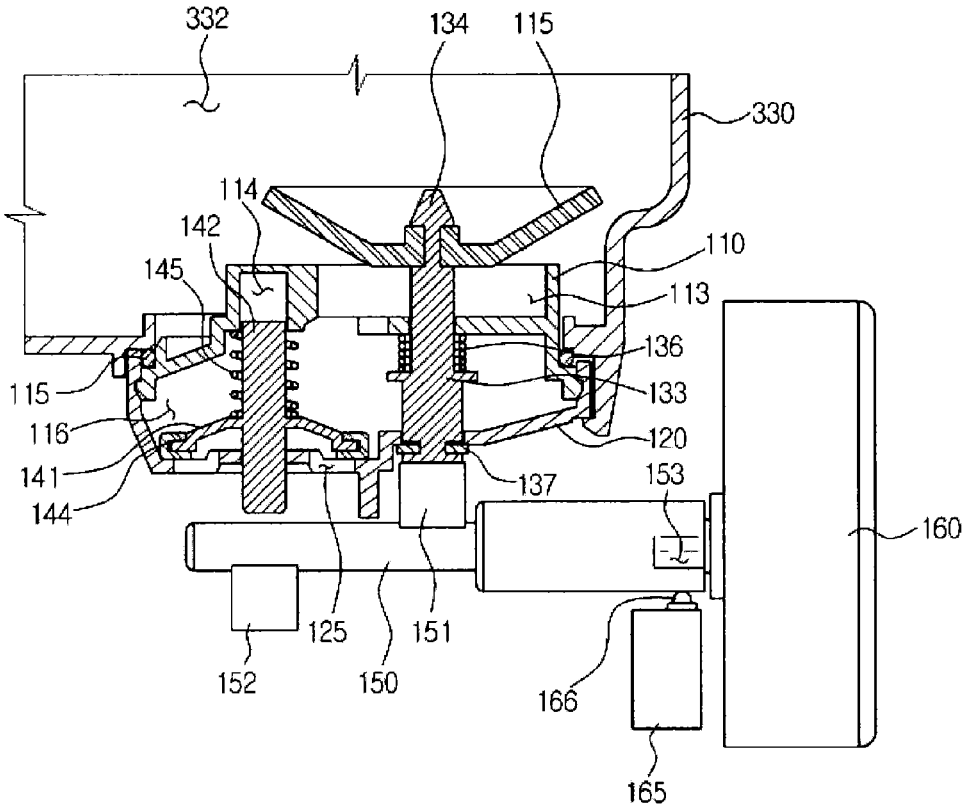
FIGS. 10 to 11 are drawings illustrating an operation of the valve apparatus on FIG. 6.
Figure 11:
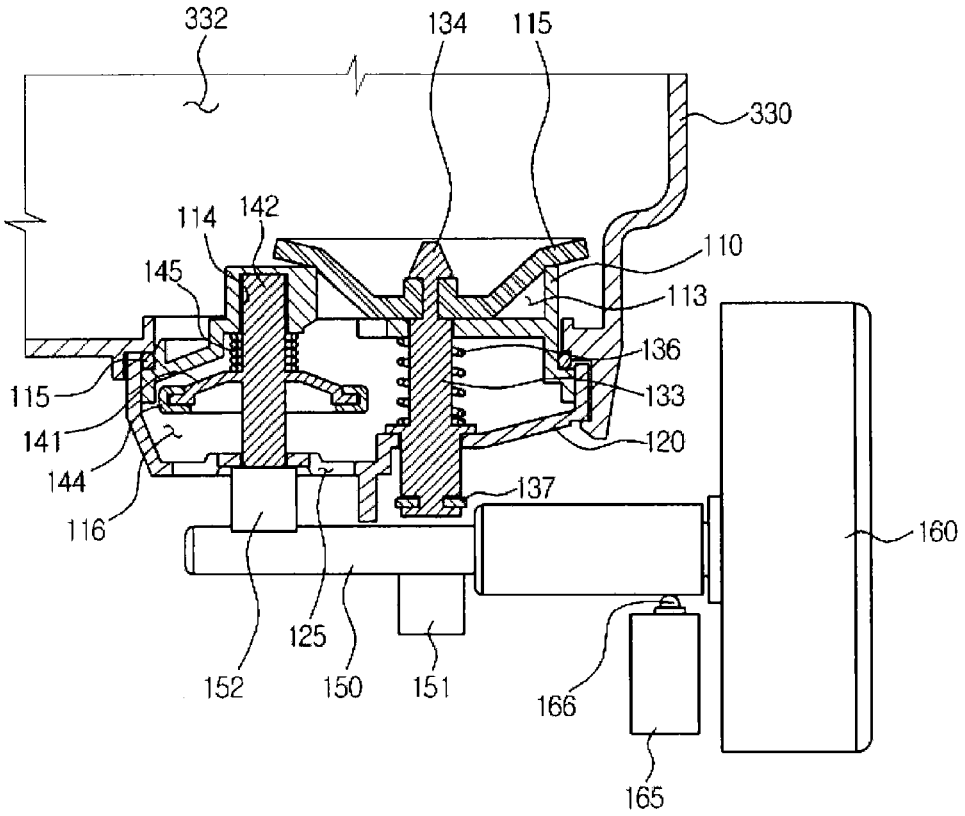

FIGS. 10 and 11 are drawings illustrating an operation of the valve apparatus on FIG. 6.

FIG. 10 is a drawing illustrating the state of wash water introduced to the detergent accommodating room 116 of the valve apparatus 100 from the detergent container 200.

As illustrated on FIG. 10, if the inlet protrusion 151 pushes the inlet shaft 133 toward an upper side as the cam 150 is rotated, the inlet valve 131 coupled to the inlet shaft 133 as well ascends toward an upper side. As the inlet valve 131 is ascended toward an upper side, the detergent inlet hole 113 is open, and the detergent at the detergent container 200 fills the detergent accommodating room 116.

In the state as such, the outlet protrusion 152 is formed in a way to face the opposite direction of the inlet protrusion 151, the outlet protrusion 152 does not push the outlet shaft 142 toward an upper side. That is, the outlet valve 141 is pressed toward a lower side only by the second spring 145, thereby closing the detergent outlet hole 125. Thus, the detergent at the detergent accommodating room 116 is not discharged to the housing room 332.

FIG. 11 is a drawing illustrating the state when the detergent at an inside the detergent accommodating room 116 is introduced to the housing room 332.

As illustrated on FIG. 11, if the outlet protrusion 152 pushes the outlet shaft 142 toward an upper side as the cam 150 is rotated, the outlet valve 141 coupled to the outlet shaft 142 ascends toward an upper side. As the outlet valve 141 ascends toward an upper side, the detergent outlet hole 125 is open, and the detergent at the detergent accommodating room 116 is introduced to the housing room 332.

The inlet protrusion 151 formed in the opposite direction to the outlet protrusion 152 does not make contact with the inlet shaft 133. At this time, the inlet valve 131 is in the state of closing the detergent inlet hole 113, the detergent at the detergent container 200 is not introduced to the detergent accommodating room 116, and only the detergent that is present at the detergent accommodating room 116 is introduced to the housing room 332. Thus, suggested amount of detergent may be introduced to the housing room 332.

By the rotation of the cam 150, the detergent may be automatically introduced from the detergent container 200 to the tub through the housing room 332. Furthermore, the suggested amount of the detergent determined by the size of the detergent accommodating room 116 may be introduced.

Since the detergent is introduced through two stages, in other words, through the stage when the detergent is filled at the detergent accommodating room 116, and through the stage when the detergent at the detergent accommodating room 116 is discharged to the housing room, the detergent at the detergent container 200 is prevented from being continuously introduced in the case when the washing machine 1 stops operating while in the process of the detergent being input.

Figure 12:
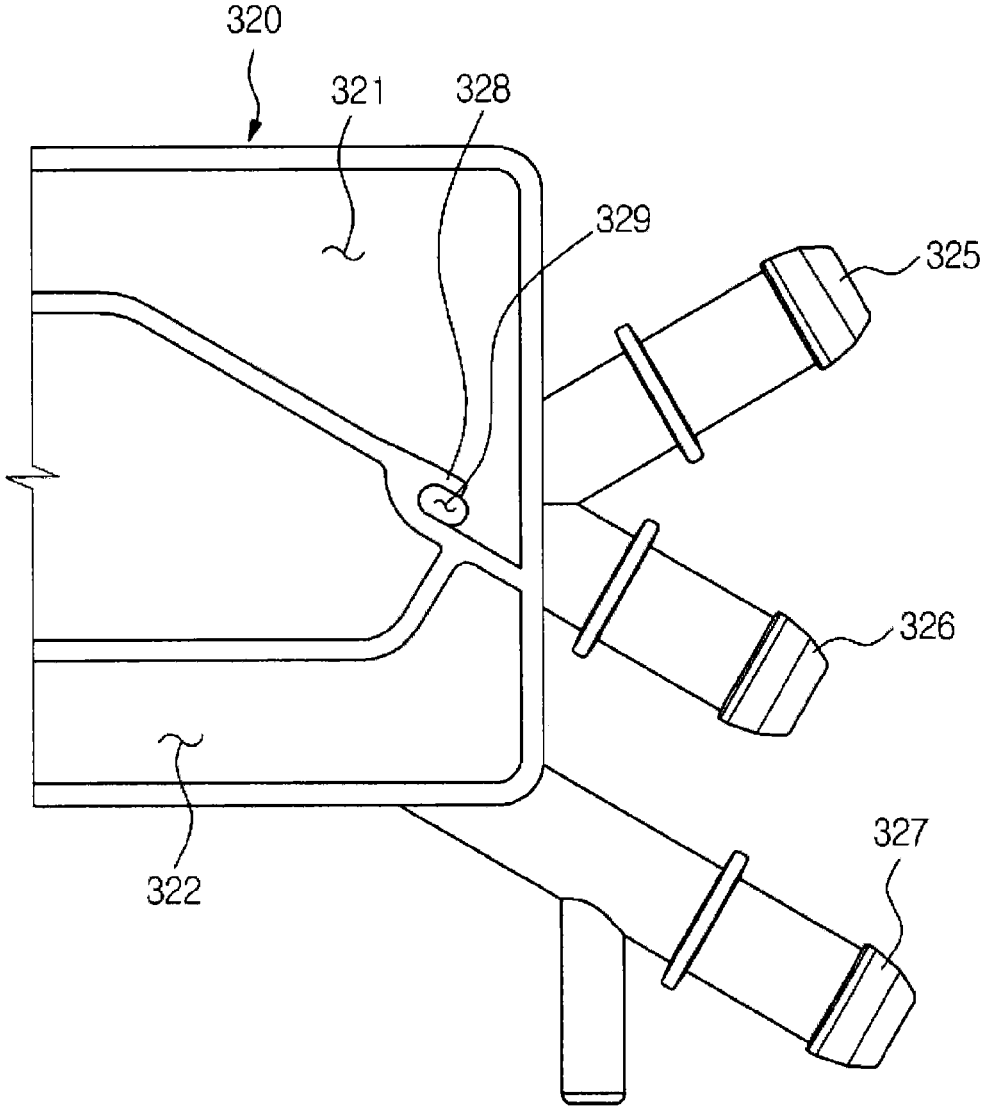
FIG. 12 is a drawing illustrating a dispenser of FIG. 4.

FIG. 12 is a drawing illustrating a dispenser of FIG. 4.

As illustrated on FIG. 12, the first connecting pipe 325 and the second connecting pipe 326 supply wash water to the first flow path 321 of the dispenser 320. With reference to the first flow path 321, a distribution hole 329 is formed at a portion at which the first connecting pipe 325 and the second connecting pipe 326 discharge wash water, and some of wash water is discharged to the distribution hole 329.

In order for the wash water, which is discharged through the first connecting pipe 325 and the second connecting pipe 326, to be easily distributed to the distribution hole 329, a distribution protrusion 328 may be formed as a boundary panel of the first flow path 321 is extended.

The distribution protrusion 328 is configured to block the wash water that is discharged, such that the wash water may be easily distributed to the distribution hole 329. By controlling the size of the distribution protrusion 328, the amount of the wash water introduced to the distribution hole 329 may be controlled. The amount of the wash water being introduced to each the first flow path 321 and the distribution hole 329 may vary, according to an embodiment, but the ratio of the amount of the wash water introduced to the first flow path 321 and the wash water introduced to the distribution hole 329 may be about 7:3.

Figure 13:
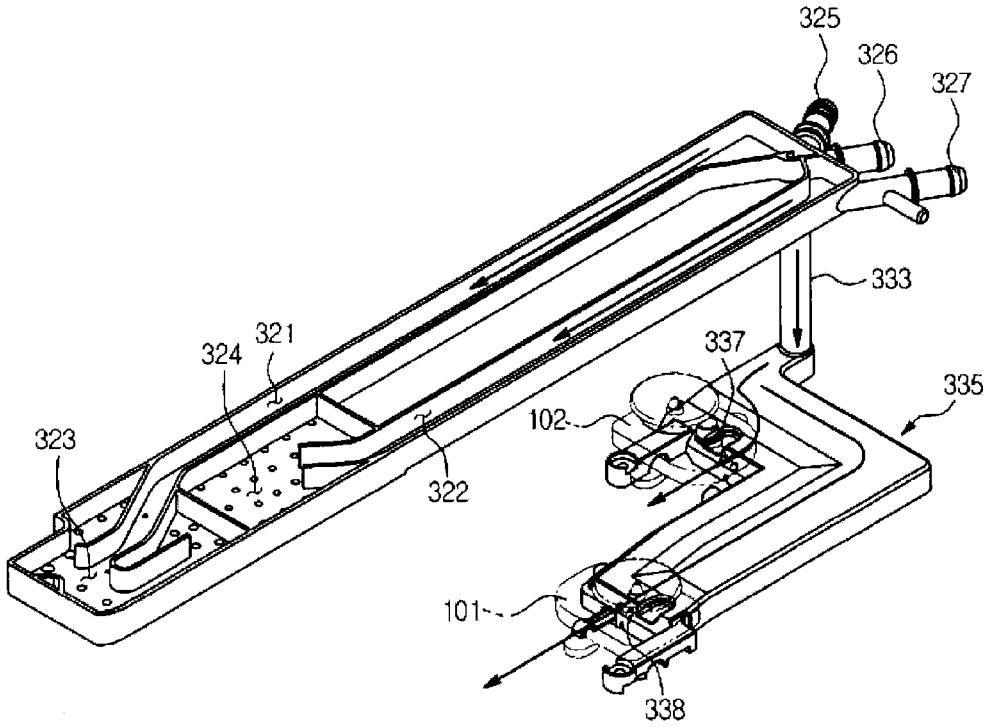
FIGS. 13 to 14 are drawings illustrating a flow of wash water of a detergent feeding apparatus of a washing machine in accordance with one embodiment.
Figure 14:
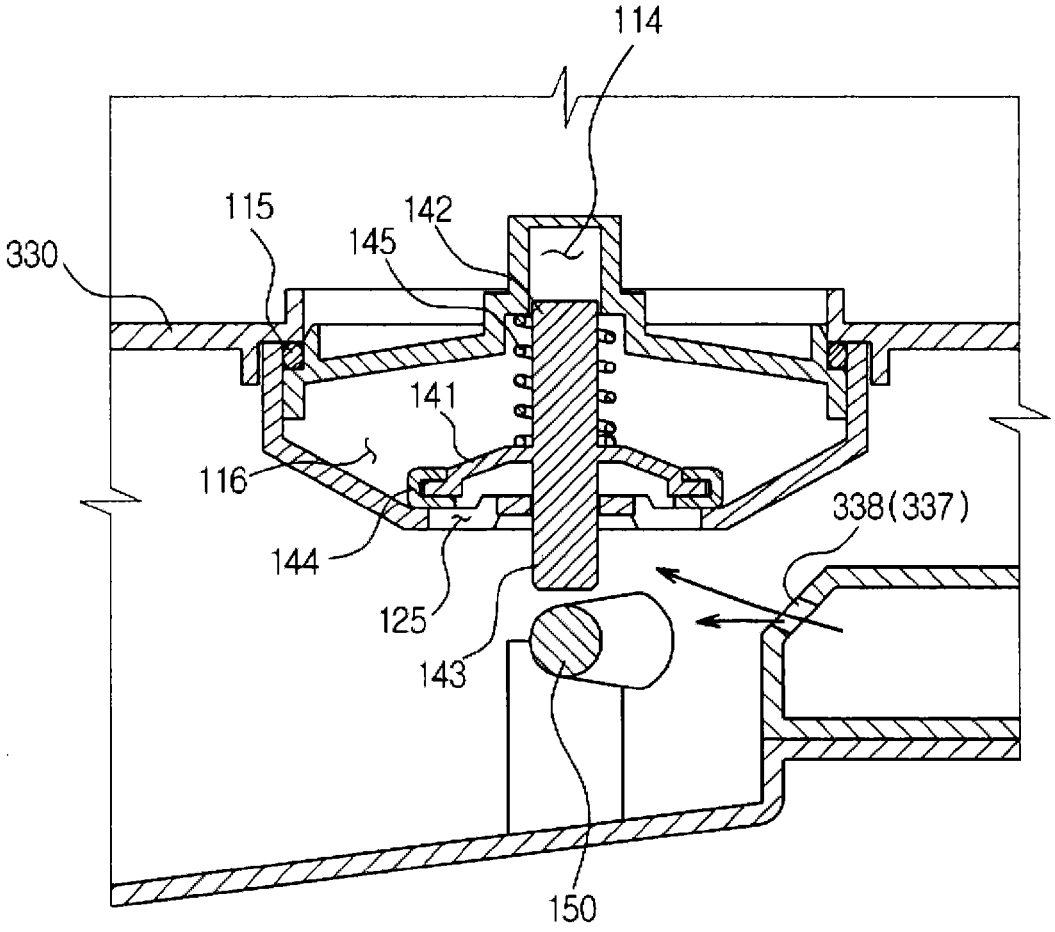

FIGS. 13 and 14 are drawings illustrating a flow of wash water of a detergent feeding apparatus of a washing machine in accordance with one embodiment of the present disclosure.

As illustrated on FIGS. 13 to 14, the wash water introduced to the distribution hole 329 is introduced, through a distribution pipe 333, to a distribution flow path 335 formed at the housing body 33 (FIG. 4).

A first outlet hole 337 and a second outlet hole 338 are formed at the distribution flow path 335. The wash water introduced to the distribution flow path 335, through the first outlet hole 337 and the second outlet hole 338, is discharged to the housing room 332.

The first valve apparatus 101 is adjacently disposed to the first outlet hole 337, and the second valve apparatus 102 is adjacently disposed to the second outlet hole 338. In particular, with reference to the valve apparatus 100, the first outlet hole 337 and the second outlet hole 338 are formed, such that wash water may be discharged toward the detergent outlet hole 125.

The wash water is discharged to the detergent outlet hole 125, and along with the detergent that is discharged from the detergent outlet hole 125, is introduced to the tub 20 (FIG. 1). Furthermore, since the wash water is discharged to the detergent outlet hole 125, the function in preventing the detergent outlet hole 125 from being clogged or polluted by the detergent having viscosity may be performed.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. A washing machine, comprising:

a cabinet;

a tub disposed at an inside of the cabinet to accommodate water; and a detergent feeding apparatus configured to supply a detergent along with a wash water to the tub, wherein the detergent feeding apparatus, comprises:

a detergent container housing installed at an inside of the cabinet, a detergent container detachably mounted at the detergent container housing while accommodating a detergent, and at least one valve apparatus configured to allow a detergent accommodated in the detergent container to be automatically put into the detergent container housing, and wherein the at least one valve apparatus, comprises:

a cap, a detergent inlet hole in an upper portion of the cap and a detergent outlet hole in a lower portion of the cap, a detergent accommodating room configured to accommodate a detergent at an inside therein and to communicate with the detergent inlet hole and the detergent outlet hole and formed at least in part by the upper portion of the cap and the lower portion of the cap, an inlet valve configured to open the detergent inlet hole to allow a detergent in the detergent container to be introduced to the detergent accommodating room and to close the detergent inlet hole to not allow the detergent in the detergent container to be introduced to the detergent accommodating room and at least a part of the inlet valve connectable with the upper portion of the cap, and an outlet valve configured to open the detergent outlet hole to allow a detergent in the detergent accommodating room to be discharged to the detergent container housing and to close the detergent outlet hole to not allow the detergent in the detergent accommodating room to be discharged to the detergent container housing and at least a part of the outlet valve disposed within the cap, and wherein the at least one valve apparatus configured to open the detergent inlet hole and close the detergent outlet hole at a same time.

2. The washing machine of claim 1, wherein:

the inlet valve and the outlet valve alternatively operate, and an introduction of the detergent into the detergent accommodating room from the detergent container and a discharge of the detergent from the detergent accommodating room to the detergent container housing are alternatively occurred.

3. The washing machine of claim 1, wherein:

the detergent feeding apparatus further comprises a valve driving unit disposed at a lower portion of the valve apparatus, and configured in a way that the inlet valve and the outlet valve are alternatively operated.

4. The washing machine of claim 3, wherein:

the valve apparatus further comprises an inlet shaft to allow the inlet valve to operate in a way to move vertically, and an outlet shaft configured to allow the outlet valve to operate in a way to move vertically.

5. The washing machine of claim 4, wherein:

the valve driving unit comprises a cam rotatively disposed at a lower portion of the valve apparatus, and as the cam is rotated, the outlet shaft and the inlet shaft are alternatively ascended or descended.

6. The washing machine of claim 5, wherein:

the cam comprises an inlet protrusion to move the inlet shaft vertically, and an outlet protrusion to move the outlet shaft vertically.

7. The washing machine of claim 6, wherein:

the inlet protrusion and the outlet protrusion are formed on opposing surfaces of the cam, and the inlet protrusion and the outlet protrusion extend from the respective opposing surface of the cam in opposite directions.

8. The washing machine of claim 1, wherein:
the detergent feeding apparatus further comprises an outlet hole to discharge the wash water to the outlet valve.

9. The washing machine of claim 1, wherein:
the detergent container comprises an automatic detergent accommodating unit at which detergent automatically supplied by the valve apparatus is accommodated, and a manual detergent accommodating unit at which detergent manually supplied is accommodated.

10. The washing machine of claim 9, wherein:
the automatic detergent accommodating unit is connected to the at least one valve apparatus.

11. The washing machine of claim 9, wherein:
the detergent feeding apparatus, in order to supply the wash water to the manual detergent accommodating unit, further comprises a dispenser mounted at an inside of the detergent container housing while being disposed at an upper portion of the manual detergent accommodating unit.

12. The washing machine of claim 11, wherein:
the dispenser comprises at least one flow path configured to supply the wash water to the manual detergent accommodating unit.

13. The washing machine of claim 12, wherein:
the detergent feeding apparatus further comprises a distribution flow path to supply the wash water to the valve apparatus and connected to the dispenser.

14. The washing machine of claim 13, wherein:
the at least one flow path comprises a distribution hole formed in a way that the wash water is distributed to the distribution flow path.

15. The washing machine of claim 14, wherein:
the distribution flow path comprises an outlet hole formed at one end portion of the distribution flow path to discharge wash water toward the valve apparatus.

16. The washing machine of claim 14, wherein:
the dispenser comprises at least one partition to divide the at least one flow path, and a distribution protrusion protrudedly formed from the partition to surround a portion of the distribution hole.

17. The washing machine of claim 16, wherein:
by controlling a size of the distribution protrusion, the amount of the wash water introduced to the distribution hole is controlled.

18. A detergent feeding apparatus, comprising:
a cap;
a detergent container configured to accommodate a detergent and formed at least in part by an upper portion of the cap and a lower portion of the cap;
a detergent container housing configured to accommodate the detergent container; and
a valve apparatus configured to allow a detergent accommodated in the detergent container to be automatically input to the detergent container housing, and
wherein the valve apparatus, comprises:
a detergent inlet hole in an upper portion of the cap and configured to allow detergent to be introduced to an inside of the valve apparatus,
a detergent outlet hole in the lower portion of the cap and configured to allow detergent to be discharged to the detergent container housing from the inside the valve apparatus,
an inlet valve configured to open the detergent inlet hole to allow a detergent to be introduced to an inside of the valve apparatus and to close the detergent inlet hole to not allow the detergent to be introduced to an inside of the valve apparatus and at least a part of the inlet valve connectable with the upper portion of the cap,
an outlet valve configured to open the detergent outlet hole to allow a detergent to be discharged to the detergent container housing from the inside the valve apparatus and to close the detergent outlet hole to not allow the detergent to be discharged to the detergent container housing from the inside the valve apparatus and at least a part of the outlet valve disposed within the cap, and
wherein the valve apparatus configured to open the detergent inlet hole and the detergent outlet hole at a same time.

19. The detergent feeding apparatus of claim 18, wherein:
wash water is supplied toward the detergent outlet hole.

20. A detergent feeding apparatus, comprising:
a detergent container housing;
a detergent container comprising a manual detergent accommodating unit to entirely input a detergent, which is input therein, to the detergent container housing, and an automatic detergent accommodating unit to input at least some of a detergent being accommodated therein to the detergent container housing;
a dispenser to supply wash water to the manual detergent accommodating unit; and
a valve apparatus to allow a detergent being accommodated in the automatic detergent accommodating unit to be automatically input to the detergent container housing,
wherein the valve apparatus comprises:
a cap,
a detergent inlet hole in an upper portion of the cap and a detergent outlet hole and a lower portion of the cap,
a detergent accommodating room formed at least in part by the upper portion of the cap in the lower portion of the and connectable with the detergent inlet hole and the detergent outlet hole,
an inlet valve configured to open the detergent inlet hole to allow a detergent to be selectively introduced to the detergent accommodating room and to close the detergent inlet hole to not allow the detergent in the detergent container to be introduced to the detergent accommodating room and at least a part of the inlet valve connectable with an upper portion of the cap, and
an outlet valve configured to open the detergent outlet hole to allow a detergent contained inside the detergent accommodating room to be selectively discharged to the detergent container housing and to close the detergent outlet hole to not allow the detergent in the detergent accommodating room to be discharged to the detergent container housing and at least a part of the outlet valve disposed within the cap.

21. The detergent feeding apparatus of claim 20, further comprising:
a distribution flow path to allow wash water at the dispenser is distributed to the valve apparatus.

22. The detergent feeding apparatus of claim 21, wherein:
the distribution flow path discharges wash water to the outlet valve of the valve apparatus.

23. The detergent feeding apparatus of claim 21, wherein:
the dispenser comprises a distribution hole to allow wash water to be introduced to the distribution flow path.

24. The detergent feeding apparatus of claim 23, wherein:

the dispenser comprises a distribution protrusion formed around the distribution hole to introduce wash water to the distribution hole.

25. A washing machine comprising a cleaning agent dispenser, comprising:

a cleaning agent dispenser housing;

a detachable cleaning agent container insertable in the cleaning agent housing;

at least one cleaning agent accommodation space configured to hold the cleaning agent introduced into the detachable cleaning agent container; and at least one valve apparatus configured to automatically discharge a cleaning agent from the cleaning agent accommodation space into the cleaning agent dispenser housing;

wherein the valve apparatus comprises:

a cap, an inlet in an upper portion of the cap and configured to allow a cleaning agent to be introduced to an inside of the valve apparatus, an outlet in a lower portion of the cap and configured to allow a cleaning agent to be discharged from the inside of the valve apparatus, an inlet valve configured to open the inlet to allow the cleaning agent to be introduced to the inside of the valve and to close the inlet to not allow the cleaning agent to be introduced to the inside of the valve and at least a part of the inlet valve connectable with the upper portion of the cap, and an outlet valve configured to open the outlet to allow the cleaning agent to be discharged from the inside of the valve and to close the outlet to not allow the cleaning agent to be discharged from the inside of the valve and at least a part of the outlet valve disposed within the cap, and wherein the valve apparatus configured to open the inlet and to close the at a same time.

26. The washing machine of claim 4, wherein at least a part of the outlet shaft protrudes through a bottom surface of the cap.

* * * * *